US006287111B1

(12) United States Patent
Gensler

(10) Patent No.: US 6,287,111 B1
(45) Date of Patent: Sep. 11, 2001

(54) LOW NOX BOILERS, HEATERS, SYSTEMS AND METHODS

(76) Inventor: Wayne Gensler, P. O. Box 496, Point Pleasant, PA (US) 18950

( * ) Notice: Subject to any disclaimer, the term of this patent is extended or adjusted under 35 U.S.C. 154(b) by 0 days.

(21) Appl. No.: 09/419,235

(22) Filed: Oct. 15, 1999

(51) Int. Cl.[7] ..... F23D 14/02
(52) U.S. Cl. ..... 432/170; 432/72; 431/5
(58) Field of Search ..... 432/72, 146, 155, 432/170, 192, 212, 213; 431/5, 115, 116, 202

(56) References Cited

U.S. PATENT DOCUMENTS 1,974,610 * 9/1934 Gray ..... 432/213
4,462,792 * 7/1984 Roth et al. ..... 431/5
6,071,116 * 6/2000 Philippe et al. ..... 432/72

* cited by examiner

*Primary Examiner*—Gregory Wilson
(74) *Attorney, Agent, or Firm*—Dann Dorfman Herrell and Skillman, P.C.

(57) ABSTRACT

A heating system according to the present invention is divided into two interconnected compartments, the first having at least one burner feeder and the second having at least one receiver burner. The thermal output of these units may be equal or unequal to match the heat recovery requirements and requirements of the receiver burner for feeder flue gas. Fuel is fed to both the feeder and receiver burners. Heat from both burners heats the fluid to be heated within the heating system. The flue gas exiting from the feeder compartment is introduced and mixed into the receiver burners air supply, similar to conventional flue gas recirculation (FGR) type low NOx burners. The feeder may use a lean premix or rich burn quench technique to achieve low-NOx. Only one combustion air fan is required. The Ductwork is not exposed or the external exposure is very short as compared to much greater lengths of external duct work in conventional flue gas recirculation systems. The compartments and their interconnection are arranged to make maximum contact with the container or fluid flow path of the fluid to be heated. Thus, there is minimal heat loss, and no condensation to cause possible corrosion. The methods have steps consistent with the system described. There is also a system employing multiple heaters with only receiver burners and the flue gas from yet another separate feeder heater which is fed to the other heaters and combined with air at the burner(s).

31 Claims, 9 Drawing Sheets

LOW NOX BOILERS, HEATERS, SYSTEMS AND METHODS

BACKGROUND OF THE INVENTION

The present invention relates to residential and commercial heat release processes, which requires the burning of fuel with air. Specifically, the invention relates to processes regulated for achieving low nitrogen oxide (NOx), carbon monoxide (CO) and volatile organic chemicals (VOC) emissions.

This invention provides more economical means for achieving low emission levels, particularly oxides of nitrogen, while maintaining high efficiency. High efficiency also reduces greenhouse gases.

Residential units may include, among others, forced hot air heating and water heaters. Commercial units may include boilers and water heaters. Industrial units may include indirect heating such as radiant tubes.

The fuels combusted might be natural gas, refinery or process gas, and liquid distillate fuels like diesel fuel or #6 (residual) fuel oil.

NOx is an abbreviation for the collective species of nitrogen oxide and nitrogen dioxide, which are responsible for health problems, and the creation of smog. NOx is created in the intense heat of a combustion flame where nitrogen and oxygen are present. It has been long known that the suppression of flame temperature can reduce NOx significantly. NOx can also be created from fuel bound nitrogen and ammonia or other nitrogen bearing compounds that find its way into the fuel or combustion air. In this case, NOx is not reduced by a suppression of flame temperature, but NOx can be "chemically reduced" to N2 and carbon dioxide ($CO_2$) in a hot fuel-rich flame that is carbon monoxide (CO) rich.

There are a number of methods for reducing NOx, as listed below. However, all come with some economic penalty or degradation in process performance. It is an object of this invention to provide a novel method and structure that will minimize the economic penalties associated with these NOx reducing methods.

FIELD OF THE INVENTION

There are a number of techniques for reducing NOx that are well known in the prior art. Some definition of terms employed in the art and some explanation of the nature of processes known in the prior art are described below.

Ballast is a mass of gas added to a region of combustion that reduces flame temperature.

A nozzle mix burner is one in which air and gas enter the combustion zone unmixed. Such a burner has the advantage that there is essentially no chance of flashback. However, it has the disadvantage that combustion is slower than with premixing so that more CO and VOC are produced, and usually the NOx is higher.

A premix burner brings air and gas together before entering the combustion zone. This results in lower NOx and cleaner combustion. However, it allows the possibility that flashback can happen.

Diluents are gases added to a region of combustion which reduce speed of reaction and heat liberation by reducing molecular collisions between reactive molecules.

Flue gases are gas mixtures which are the results of combustion, gases which normally flow out the stack.

Rich mix has more fuel than air in the burn mixture and results in insufficient air to complete combustion.

Lean mix has more air than required for stoichiometric combustion of the fuel. Normal natural gas combustion produces about 2–3% oxygen in the flue gases. The flame extinguishes at about 12–15% oxygen in the flue gases..

Fuel bound nitrogen is nitrogen that is chemically bound in the fuel molecules.

Oxygen trim means reducing the excess oxygen too close to stoichiometric levels while maintaining a watch on the carbon monoxide regulated limits. This produces a small decrease in NOx from oil and gas nozzle-mix burners but an increase in the NOx from premix burners. Operating closer to stoichiometric improves thermal efficiency but increases pollutants such as CO and VOC.

Lean premix is a lean mix mixed before it is introduced into the combustion space. One can achieve very low-NOx by diluting the stoichiometric gas mixture with large amounts of air ballast. This moderates the flame temperature. However, the air ballast carries large amounts of heat out the stack, so that the process is thermally inefficient. This method is acceptable for air dryers where the moderated temperatures are required. The air ballast increases NOx for a nozzle-mix burner.

Quick Mix is another burner design technology that uses a nozzle mix type burner and rapidly mixes the air and the fuel in the combustion space before it can ignite. This simulates premix and is reported to obtain low-NOx.

Rich burn quench introduces air over the fire of a burner. It is mainly used to reduce oxides of nitrogen emission for nozzle-mix burners using fuel oils or gases with high levels of fuel bound nitrogen. Most of the fuel bound nitrogen is converted to NOx in the flame. This is in excess of the thermal NOx created in the hot flame. However the CO in the very rich flame reduces some of the nitrogen oxide back to nitrogen and carbon dioxide. Therefore, the remainder of the fuel requires burning before venting to atmosphere, usually with natural gas and overfire air. The proplem is matching the heat release to the heat absorbing capabilities (e.g. steam/water tubes in a boiler) and using natural gas in place of less expensive fuel oil and the additional piping and costs of natural gas.

Water or steam injection employed as ballast (as used in lean premix) and diluent injected to cool the flame temperature and reduce the combustion reaction rate thus reducing thermal NOx. The ballast carries heat out the stack. Thus it is inefficient compared to stoichiometric combustion. Water and steam may be expensive in arid areas like California.

Staged air combustion is similar to "rich burn quench" except that there is no quench so that the introduction of additional air combusts the remainder of the fuel. Usually the final combustion is close to stiochiometric; thus the process is thermally efficient. Often staged air combustion is used in combination with other techniques for lowering NOx.

Flue gas recirculation (FGR) is a technique using an extra fan to suck flue gases from the stack and usually to force them into the air stream. This is a very popular method of reducing NOx on existing and new boilers and works well with both liquid and gaseous fuels. Usually 10–30% flue gas is recirculated. There is a loss of efficiency due to recirculation fan power and cooling and condensing of the recirculated flue gas in the piping. With high sulfur fuels, condensing must be avoided to prevent corrosion; thus recirculation usually requires clean fuels. Flue gas recirculation does not reduce NOx from fuel bound nitrogen.

In situ FGR are methods of FGR whereby flue gas from the furnace is inspirated into the burner body and mixed with the air or fuel without an external loop or very short external loop. This technique is only moderately successful in reducing NOx since the inspiratation of hot flue gases requires large amounts of energy.

Zone combustion or bias combustion for long or tall furnaces allows the combustion to be split up into zones. One patent has a lean premix burner firing at one end of the furnace and fuel injectors before the end of the furnace (zone 2) where combustion and heat transfer can be completed before exiting. Thus, there are two types of burners. However, the flue products of one burner does not enter into the combustion of the other burner as in the present invention.

Co-generation is normally thought of as method for improving heat recovery from turbine-generator set or diesel-generator set. However, it does reveal a method of reducing NOx. The waste gas stream from the generator set contains a lot of oxygen and heat. To reclaim some of the waste-heat the waste gas can be sent (15% in the case of a gas-fired turbine at about 900 F.)directly to a waste heat recovery unit (boiler). Still, thermal efficiency is low due to the large amounts of excess air (ballast). Some waste recovery unit's (boiler) have burners, which uses the oxygen in the exhaust gas to complete combustion close to stoichiometric. Thus, the overall heat balance of the plant is improved and the thermal efficiency is high. The problem, of course, is that in the summer when steam is not required in large amounts, the waste heat recover unit's (boiler) are shut off and the plant is less efficient. The testing of these waste heat recovery units (boilers) burners taught that low NOx emissions could be obtained with the turbine exhaust. The turbine exhaust is similar to a mix of preheated air and flue gas recirculation.

In summary, when applying the above techniques to residential heating, flue gas recirculation is expensive to operate and maintain. Lean premix and water injection are inefficient. Staged air combustion and rich quenched lean mixtures may not fit the process requirements. Also rich quench lean creates the presence of high carbon monoxide (from rich combustion), which makes any leak in the heat exchanger or malfunction of the stack deadly. Such risks are unacceptable for residential heating units.

SUMMARY OF THE INVENTION

This invention provides a number of methods by which the above mentioned techniques for achieving low-NOx can be applied in a new system, using an improved more efficient method. Thus the invention avoids the losses in efficiency, operating complexity and high cost of current industrial low-NOx systems.

A heating system according to the present invention is divided into two interconnected compartments, the first having at least one feeder burner and the second having at least one receiver burner. The thermal output of these units may be equal or unequal to match the heat recovery requirements and requirements of the receiver burner for feeder flue gas. Fuel is fed to both the feeder and receiver burners. Heat from both burners heats the fluid to be heated within the heating system. The flue gas exiting from the feeder compartment is introduced and mixed into the receiver burners air supply, similar to conventional flue gas recirculation (FGR) type low NOx burners. The feeder may use a lean premix or rich burn quench technique to achieve low-NOx. Only one combustion air fan is required. The ductwork is not exposed or the external exposure is very short as compared to much greater lengths of external ductwork in conventional flue gas recirculation systems. The compartments and their interconnection are arranged to make maximum contact with the container or fluid flow path of the fluid to be heated. Thus there is minimal heat loss, and no condensation to cause possible corrosion.

A related system of the invention system employs multiple heaters with only receiver burners and the flue gas is obtained from yet another separate feeder heater which is fed to the other heaters and combined with air at the burner(s).

More specifically, the present invention relates to a two stage heater containing a body of fluid to be heated. A first combustion compartment within the heater has at least one feeder burner connectable to a supply of fuel and having an air supply enabling the fuel to be burned to produce a first combustion product. A second combustion compartment has at least one receiver burner connectable to a supply of fuel and having an air supply. Connection between the first and second compartments whereby the first combustion product can flow into the second combustion compartment in position to combine with air and fuel and be burned to make a second combustion product. The walls of the container for the fluid to be heated are in good thermal contact with at least the first and second combustion compartments.

The present invention also relates to a method of reducing NOx in a heater having a fluid body to be heated. The method steps are as follows: Burning fuel in a first compartment of the heater to produce a first combustion product. Applying heat from the first combustion product to the fluid body to be heated. Burning fuel in a second compartment of the heater into which the first combustion product as well as new air is introduced to produce a second combustion product. Applying heat from the second combustion product to the fluid body to be heated. Then exhausting the second combustion product.

DETAILED DESCRIPTION

Figure 1:
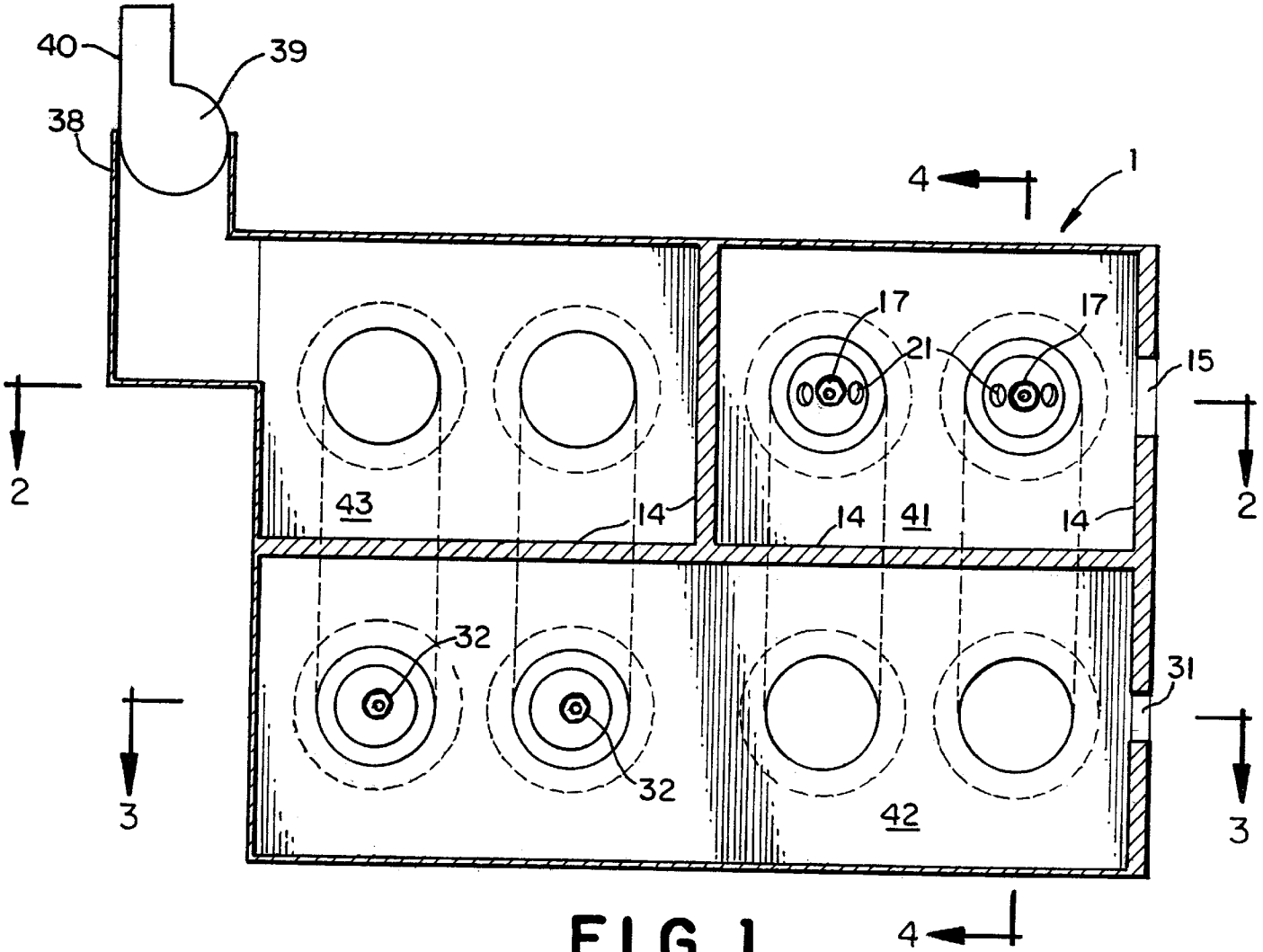
FIG. 1 is a horizontal cross sectional view of a hot-air gas-fired furnace taken beneath the air heating compartment above the burners.

FIGS. 1–4 show a hot-air heater unit 1 in which the present invention has been incorporated. Forced hot air for heating is drawn into the heating compartment 8 of the heater by fan 2 shown in FIG. 2. Fan 2 forces air through supply duct 3 and forces the cold air into the air heating compartment 8 defined by one of the internal heat transmitting walls 14 providing a floor to the compartment 8. The compartment encloses feeder combustion tubes 27 and. 35 which provide radiant heating together with heat transfer through the floor combustion tubes heat the passing air. In some embodiments the tubes may be equipped with heat transfer fins 7 to improve heat transfer to the air. Hot air exits the air heating compartment 8 of the furnace through the supply duct 4 directing the heated air to the space to be heated. Natural gas or other suitable gases is supplied as fuel 9 to the fuel pressure regulator 10 and the fuel distribution header 11, which supplies feeder burner nozzles 17 and receiver burner nozzles 32. Chamber walls and ceiling 14 create three separate compartments: the feeder burner compartment 41, the receiver burner compartment 42 and the unit flue gas compartment 43.

Figure 2:
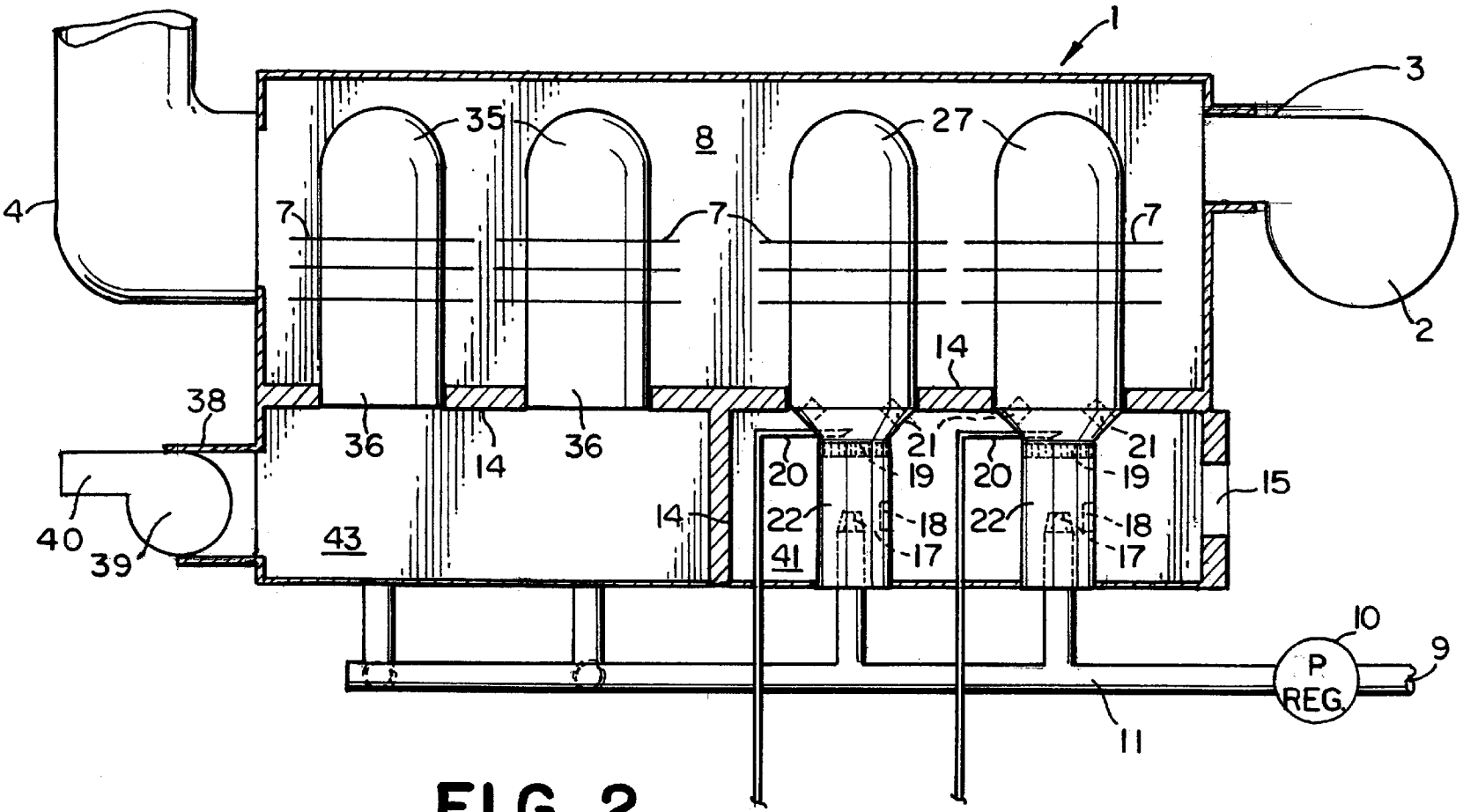
FIG. 2 is a sectional view of the furnace or water heater of FIG. 1 taken along line 2—2 of FIG. 1.
Figure 3:
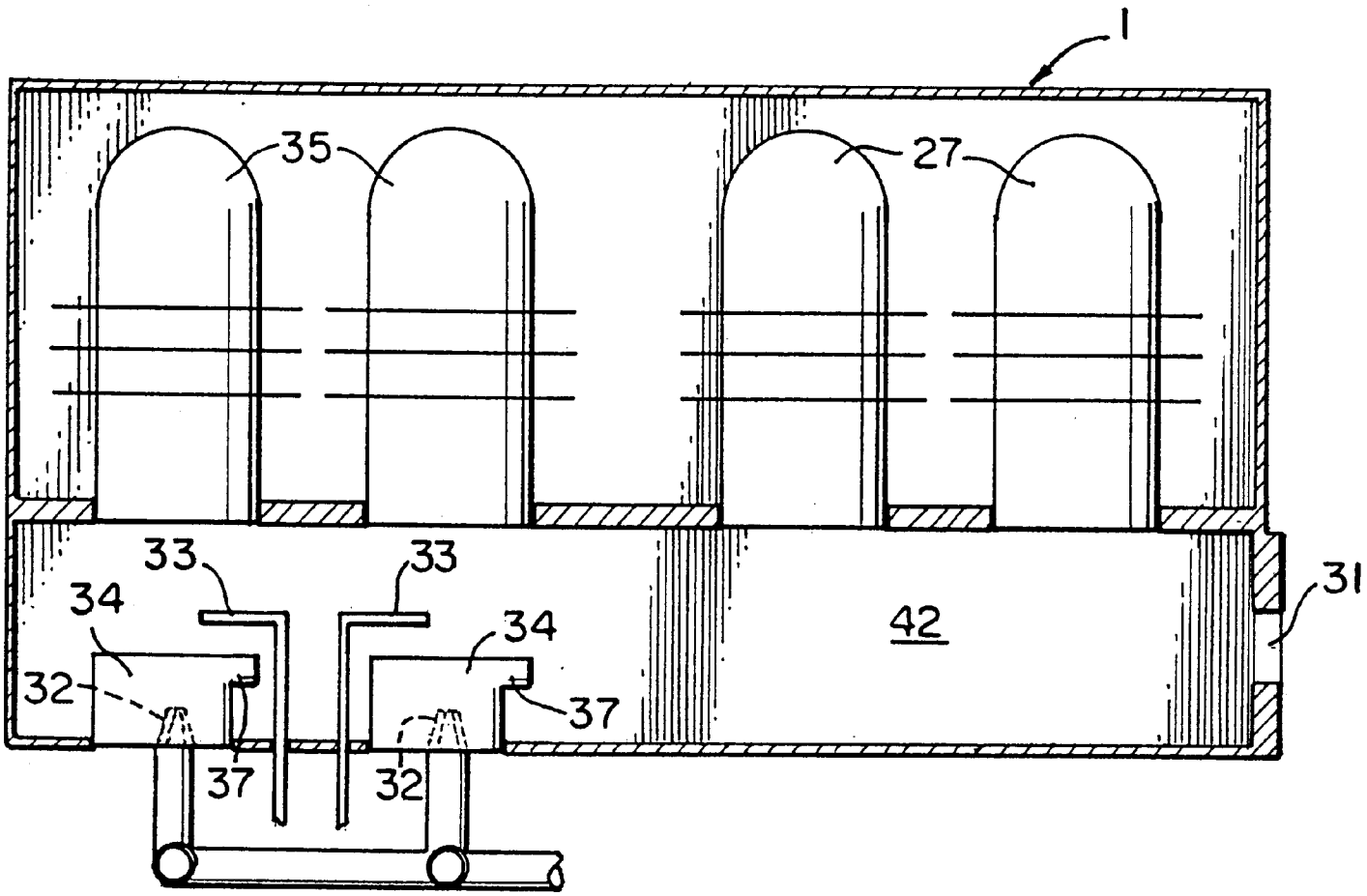
FIG. 3 is a sectional view of the furnace or water heater of FIG. 1 taken along line 3—3 of FIG. 1.
Figure 4:
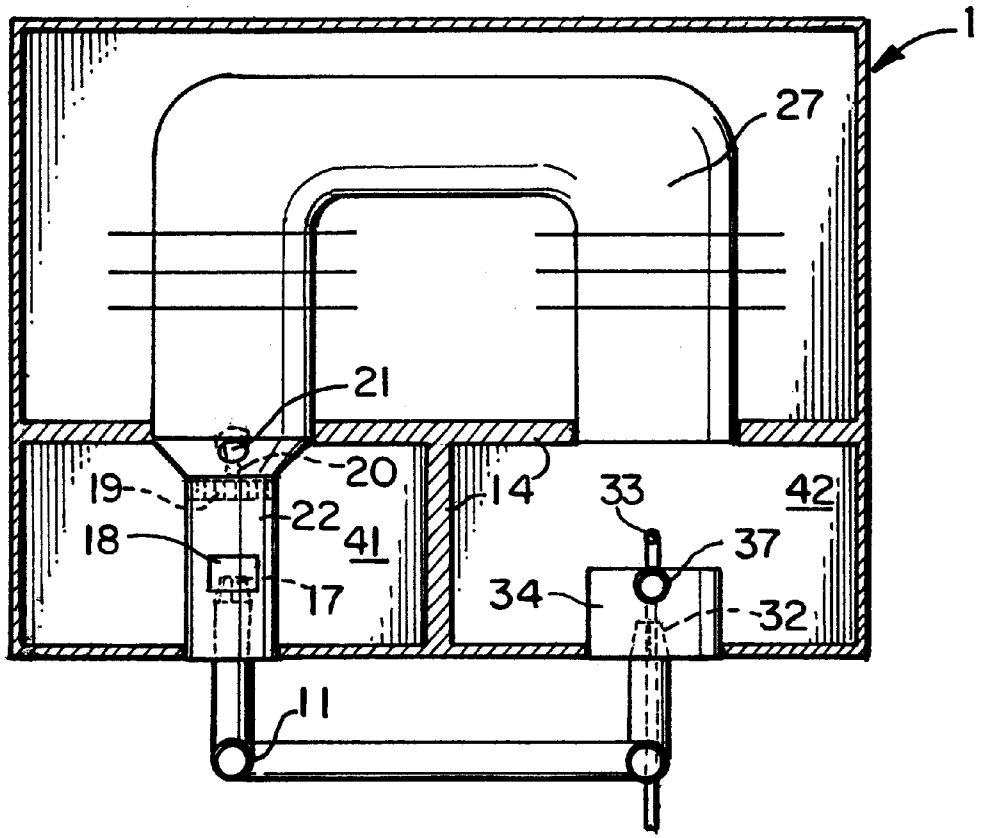
FIG. 4 is a sectional view of the furnace or water heater of FIG. 1 taken along line 4—4 of FIG. 1.

The feeder burner air enters by feeder combustion air register 15 drawn by suction created by exhaust fan 39 in flue 40 as shown in FIG. 1. Fan 39 maintains the combustion side under suction to prevent combustion gas leaks into the hot air compartment 8 or elsewhere outside the combustion exhaust chambers. Air is distributed to each feeder burner 17 via the feeder burner primary air register 18 and fuel is supplied by a metered feeder burner nozzle 17 and premixed in feeder premix chamber 22 as seen in FIG. 2. The mixture passes through the feeder burner screen 19 and is ignited and monitored by the feeder burner igniter/flame safety monitor 20. Secondary feeder burner air, if required, enters through feeder burner secondary air registers 21. The flame enters the feeder combustion tube 27 which provides a duct through which heat is transferred to the heating air in compartment 8. The cooled combusted flue gas exits the feeder combustion tube 27 and enters the receiver burner compartment 42 as seen in FIG. 3.

Additional combustion air, if required, is drawn in to the receiver burner compartment 42 by the receiver combustion air register 31 and mixes with the feeder flue gas. This supplies internally of the furnace or heating unit an air and flue gas mix, which is similar to a mix generated by recirculating flue gases (FGR technology) external to the heating unit. Some of the flue gas mix is drawn into the receiver burner intake 37 by the inspirating action of the gas leaving the receiver burner nozzle 32. The receiver burner assembly 34 is equipped with a flame holder/ glow plug 33. The mix combusts and enters the receiver combustion tube 35 through which heat is transferred to the heating air flow through compartment 8. The cooled combusted flue gas exits the receiver combustion tubes 35 through a metering orifice 36 to control flow distribution, then into the unit flue gas compartment 43. The flue gas exits through the flue gas duct 38 through the combustion air fan 39 to the atmosphere through a chimney (not shown).

Industrial experience has shown that the lowest NOx can be obtained with either lean-premix (or quick mix technology) or external flue gas recirculation (FGR). In a first embodiment of the invention, the concept of both of these methods are used to obtain low NOx without (1) the extra capital and operating cost of an extra fan for FGR, (2) the cost of external duct work associated with FGR, (3) the loss of efficiency due heat losses from the external duct work for FGR, and (4) the loss of efficiency of ballast (excess air) carrying heat out the stack with lean-premix. Most or all of the air for the total and complete combustion of the fuel fired in the hot-air heater unit 1 enters in through the feeder combustion air register 15 into the feeder premix chamber 22. The percent of total fuel to the feeder burner assembly 23 is generally between 50% to 60%. If there is too much air in the premix to the feeder burner assembly 23, combustion could be quenched, therefore there is means to bypass some air around the feeder premix chamber 22 by way of the feeder burner secondary air registers 21 or receiver combustion air register 31. The merits of very lean premix for generating low NOx are well known in the industry. The cooled combusted flue gas exits the feeder combustion tube 27 and enters the receiver burner compartment 42. Additional combustion air (if required) is drawn in the receiver combustion air register 31. The mixture of diluted air is the same as if the unit were equipped with an external flue gas recirculation (FGR). This mix is then used by receiver burner assembly 34 to burn with low-NOx essentially in the manner known from the practice of external flue gas recirculation (FGR).

In a second embodiment of the invention the feeder burner 19 operates in a normal high NOx mode. It supplies about one-third to one-fifth the heat input of the heater unit 1. Only slightly more than stoichiometric air for the feeder burner assembly 23 fuel consumption enters in through the feeder combustion air register 15 into the feeder premix chamber 22 or feeder burner secondary air registers 21. The feeder burner employed may thus be a conventional burner. The cooled combusted flue gas exits the feeder combustion tube 27 and enters the receiver burner compartment 42. Air for receiver gas combustion is drawn in the receiver combustion air register 31. The mixture of diluted air which is equivalent to having 20–30% flue gas recirculation is then used by the receiver burner to burn with low-NOx as is well known from the practice of external flue gas recirculation (FGR). The NOx is not as low as the first embodiment of the invention, since it is the average of one conventional burner and four to six low-NOx burners of the same size.

Figure 5:
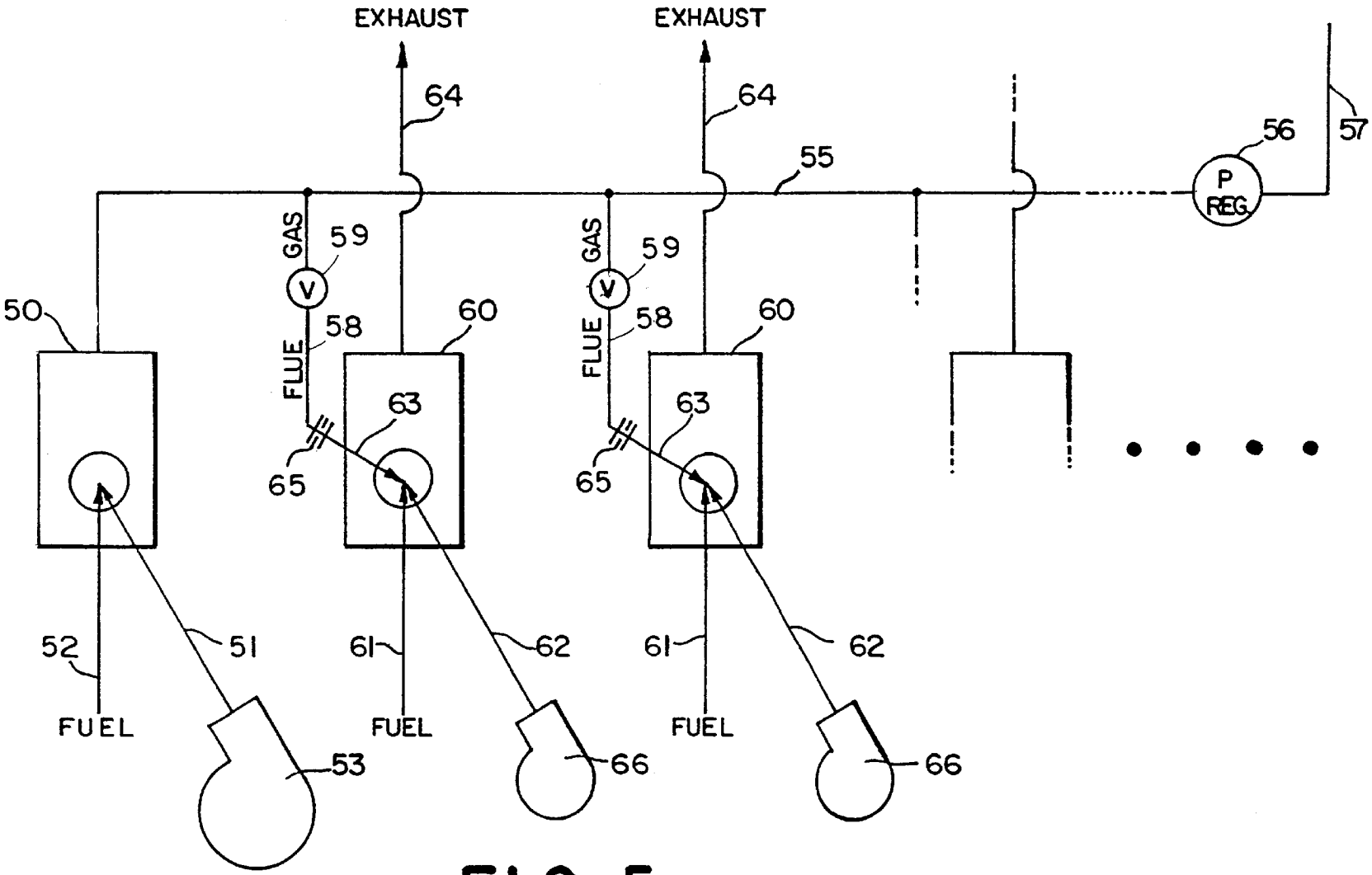
FIG. 5 is a schematic view representing a plurality of heaters having receiver burners which receive and employ the exhaust from separate heater having a supply burner which together provide the advantages of the present invention.

FIG. 5 schematically represents a novel configuration of conventional prior art heater units or boilers. Additional parallel units 60 normally make for greater efficiency. A plurality of typical receiver units 60 are equipped with low-NOx flue gas recirculation type burners as are commercially available. All are connected in parallel to a common flue gas feeder duct 55 provided with a back pressure regulator 56 and the receiver flue gas orifice 65 controls the flow of the feeder flue gas to each receiver unit 60. Each receiver unit 60 receives air from a receiver air supply duct 62 pressured by a receiver combustion air fan 66. Each receives fuel from a supply line 61 from a fuel supply which is mixed with air and flue gas from a flue gas injector 63. Each may receive flue gas from a feeder unit 50, similar to each of the receiver units 60. The feeder unit supplied fuel through line 52 and air from fan 52 through air supply 51. Feeder ducts 58 receive flue gas from feeder unit 50 through a common duct 55. Combustion and heat transfer occurs in the receiver units 60 and the resulting flue gas is exhausted to atmosphere through the exhausted duct 64 to the receiver stack 64. The feeder unit combustion air fan operates at a higher pressure than the receiver unit's air fan.

An advantage of this parallel configuration over flue gas recirculation systems is the elimination of separate recirculation fans for each of the units with a capital and operating savings. The passing of flue gases from the exhaust of a feeder unit 50 through a boiler which is not operating will provide a hot stand-by unit without expending extra fuel. Thus the overall efficiency of the boiler system is increased. A disadvantage is that when only one boiler is operating there is no decrease in NOx. However, regulatory agencies exempt certain age and size boilers from NOx regulations. Thus depending on the boiler house arrangement, this invention may satisfy regulatory requirements at all times.

Those skilled in the art will understand the system permits use of an alternate backup feeder unit, that is normally a receiver unit 60 by the use of shut off valves 59 in the feedback ducting 58, for use when the feeder unit 50 requires repairs.

FIG. 5 shows that improvements in heating systems can be separated by an internal wall or can be two or more completely independent heating systems. Thus, FIG. 5 shows the flue gases of one boiler fed into a multiple of other boilers. A number of scenarios may be used here; for example the feeder system supplies flue gas for four or five other systems.

Another scenario would be the feeder system or systems supplies rich flue gas recirculation from rich burn quench low-NOx technology, and the receiver Systems supply more air and fuel to meet their heat input requirements and the requirements of good combustion.

Figure 6:
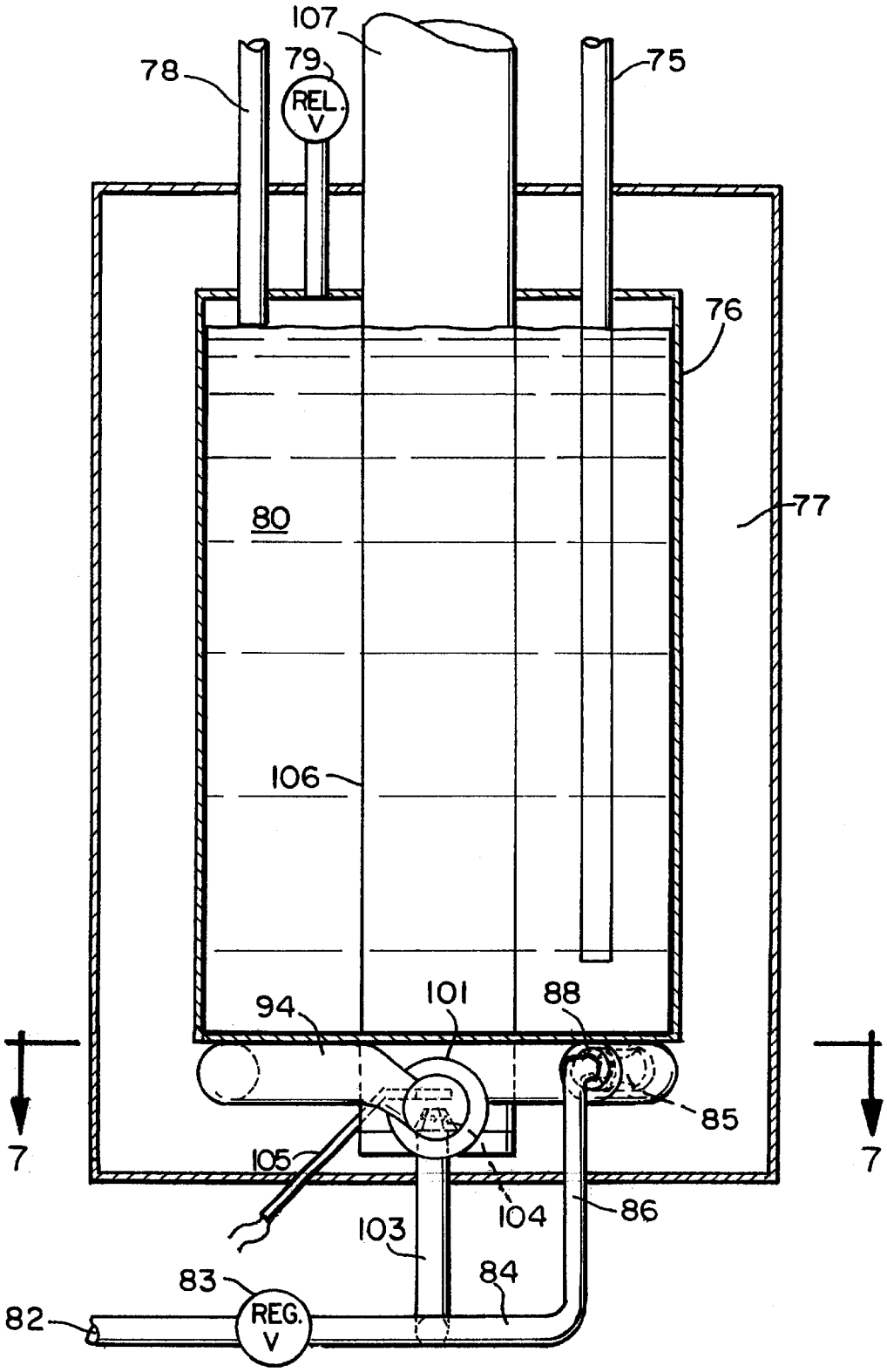
FIG. 6 is a vertical sectional view of a water heater employing the present invention.
Figure 7:
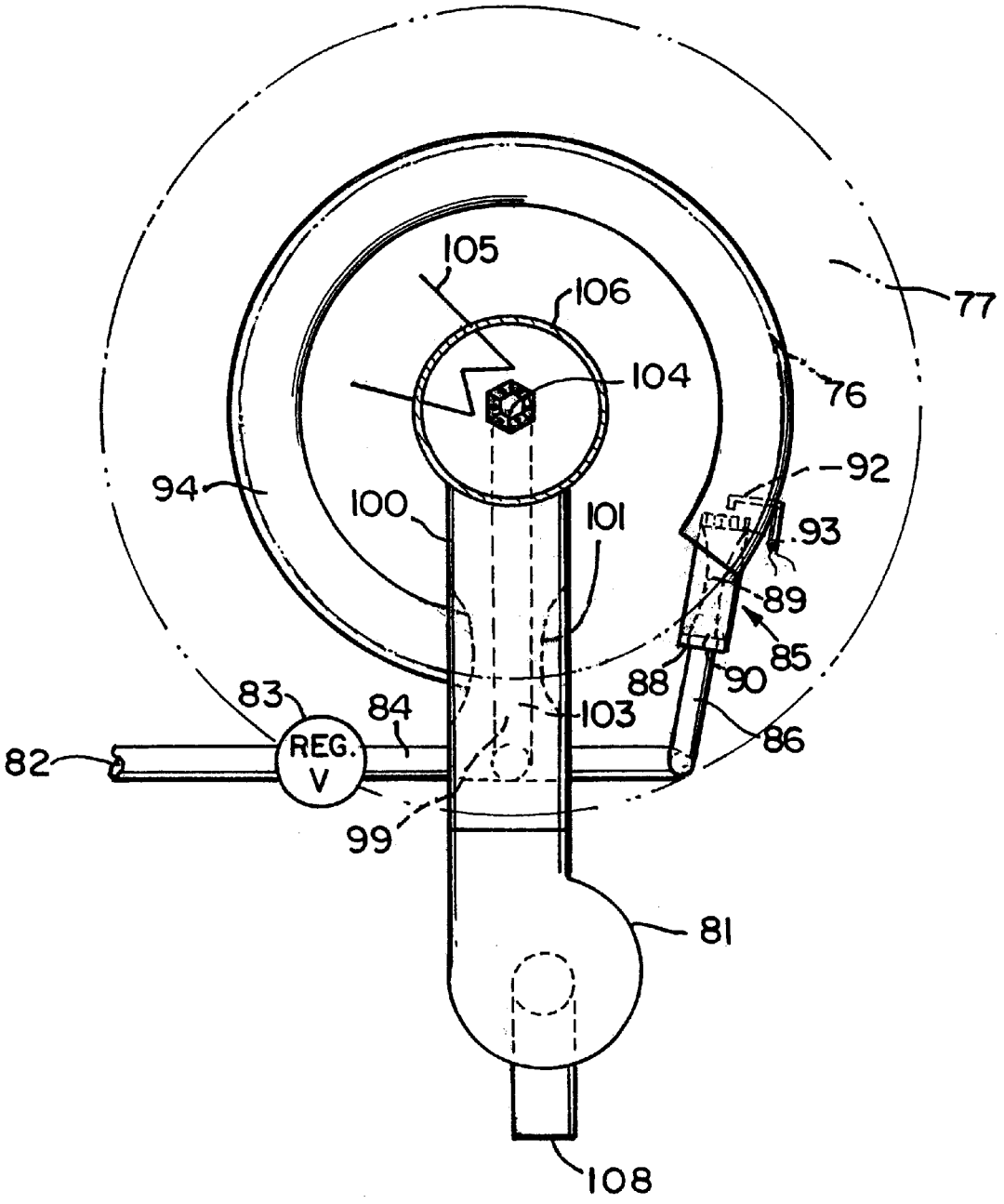
FIG. 7 is a horizontal sectional view taken through the water heater of FIG. 6 taken along line 7—7 of FIG. 6 to show the burner from above with only the suggestion of the relative location of other heater parts.

FIG. 6 and 7 show a water heater, which typically might be used in homes, modified to employ features of the present invention. Many of the structured parts will be recognized as conventional. Typically the water to be heated 80 is contained in a torroidal tank 76 provided by the metal walls designed to sustain some steam as well as water pressure. The outer walls of the tank 76 is shown in an embodiment of the invention for a small capacity hot-water heater that is found in homes and commercial facilities. A hot-water heater pressure shell 76 is surrounded by insulation 77. A cold water feed pipe 75 enters through the top of the tank and extends to near the tank's bottom. Hot water exits through a hot water supply pipe 78. The pressure shell 76 is equipped with a pressure relief valve 79 extending supported on a pipe fixed through the top wall of the tank, as is well known in the practice.

The main burner, here receiver burner 104, is centered below the tank. Fuel supply pipe 82 enters to gas regulator 83 which supplies gas to the gas distribution header 84. Header 84 then distributes gas both to the receiver gas supply pipe 103 and the receiver burner tip 104, and to feeder gas supply pipe 86 and then the feeder gas orifice 90. The feeder burner air is drawn in by the combined effects or the receiver air tube venturi 101 and the inspirating action of the fuel gas in the feeder venturi 89. Combustion air is supplied by a combustion air fan 81 (FIG. 7), which is equipped with a receiver air register 108 at its entrance for controlling combustion air flow to the receiver burner tip 104 through the receiver air tube 100 and receiver air tube venturi 101.

The feeder combustion air is metered by and enters by the feeder air register 88 and the feeder fuel is metered by the feeder gas orifice 90. The feeder fuel and feeder air is mixed in the feeder venturi 89 and combusted on the downstream side of the feeder burner screen 93. It is ignited and monitored by the feeder igniter/flame monitor 92. The flame enters the generally annular feeder combustion tube 94, which is firmly attached to the outside of the bottom of the hot water heater pressure shell 76. Heat is transferred to the water 80 in the tank and the cooled flue gas is drawn from feeder combustion tube 94 into the receiver air tube venturi 101 to mix with the receiver air 99 to create a mixture equivalent to 15–25% external flue gas recirculation. The mixture mixes with receiver gas discharged from the receiver burner tip 104 and is ignited by the receiver glow wire 105 and combustion takes place in the main heat transfer tube 106 where heat is transferred to the water 80 in tank 76 and then exits to the atmosphere through the exhaust duct 107. Thus the feeder burner, generates conventional Nox, or slightly lower NOx than the conventional type burner, if it is operated slightly lean, while the receiver burner generators low NOx as would be expected from an FGR type burner, and the units NOx is the proportional average of the two streams.

Figure 8:
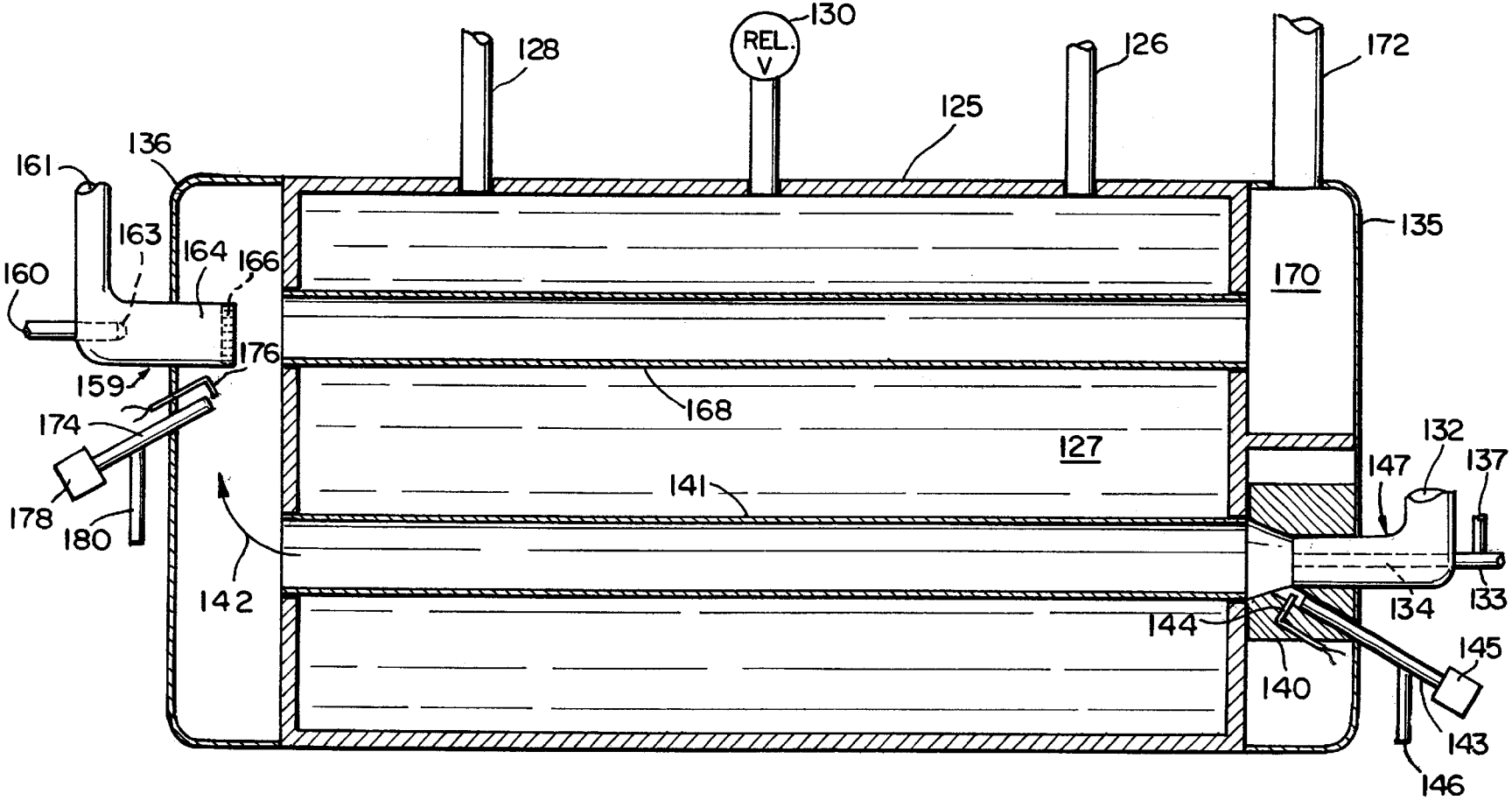
FIG. 8 is a sectional view through a fire-tube boiler employing the present invention.

FIG. 8 shows an embodiment of the invention employed with in a commercial large pressure shell 125 of a water heater or steam boiler. A cold water inlet pipe 126 supplies the water 127 to be heated, The hot water/steam outlet pipe 128 at the top of the boiler supplies hot water or steam to users. A pressure relief valve 130, and gauges as desired, are also provided at the top of the boiler. Two compartments are formed outside the pressure shell 125 by the front door 135 and the back door 136 of the boiler. A blow-down and water preparation system (not shown) are normally employed in accordance with the practice well known in the industry. The feeder pilot 143 is supplied pilot gas and air mix 146 through inlet pipes, which gas is ignited by feeder pilot igniter 144. Flame safety is provided by a UV sensor acting as feeder pilot flame sensor 145 as is commercially available and well known in the industry.

Air enters the feeder burner assembly 147 through the feeder forced air supply duct 132. Oil fuel is introduced by the feeder burner fuel line 133 into the feeder oil gun 134 along with atomizing steam through line 137 if required. The air and the fuel mix and, ignited by the pilot burner, in the feeder burner block 140 and enter the feeder heat transfer tube 141. The receiver pilot 174 is provided with air and pilot gas premix 180 and is ignited by receiver pilot igniter 176. Flame safety is provided by UV sensor receiver pilot flame sensor 178. Gas from the receiver gas supply 160 enters the receiver premix chamber 164. Receiver forced air 161 is also introduced through the receiver premix chamber 164, and mixes with fuel and burns on the receiver burner screen 166. The ratio is sub-stoichiometric so that NOx created by fuel bound nitrogen and combustion is reduced in the rich atmosphere. This is the well known and proven technique for reducing NOx referred to as a rich burn quench with natural gas re-burn.

Thus the exiting feeder flue gas 142 is fuel-rich and must be re-burned by introducing more air and increasing the temperature of the air with a portion of natural gas injection so that combustion is sustained and completed before exiting the unit. The receiver pilot 143 is provided with air and pilot gas premix 146 and is ignited by receiver pilot igniter 144. Flame safety is provided by UV sensor receiver pilot flame sensor 178. [Gas from the receiver gas supply 160 enters the receiver premix chamber 164.] Receiver forced air 172 is also introduced through the receiver premix chamber 134, and mixes with fuel and burns (on the receiver burner screen 166 out of the burner block 140). Alternately one might use quick mix type burner. The receiver burner premix has enough air to complete combustion for the fuelrich feeder flue gas 142 and the re-burn natural gas injection. The mix completes combustion in receiver heat transfer tube 168 and exits through exhaust chamber 170 and unit stack 172. Some boilers use more unfired passes to increase efficiency, as is well known in the art. Such variations are not shown for simplicity but would occur to the man skilled in the art. The added capital expense of an extra burner can be offset by the ability to burn less expensive, and possibly more available, fuel, for example, during natural gas curtailment.

Another embodiment of the invention for burning all natural gas involves some modifications. The feeder burner assembly 147 uses lean-premix or quick mix technology to obtain low-NOx combustion and the receiver burner assembly 159 uses flue gas recirculation type burner technology. The flue gas exiting feeder flue gas 142 is equivalent to 20–30% flue gas recirculation mixed with the required amount of combustion air. Additional air, if required, may be provided through receiver forced air 161. The advantage of the invention over flue gas recirculation (FGR) is that there is no extra operating expense for the recirculation fan electricity and no heat-loss (loss of efficiency) due to external ducts.

Still, another embodiment of the invention modifies the feeder burner assembly 147 to provide about one-third to one-fifth the total heat-input as the receiver burner assembly (159). Thus the feeder burner assembly 147 would supply only the equivalent of 20–30% flue gas recirculation, which would be mixed with the receiver forced air 161 and then mixed with the fuel in a burner designed for FGR (flue gas recirculation burners commercially available).

Two examples of use of the type of system of FIG. 8 as follows illustrates the versatility of the system:

Case 1: A scotch tube boiler (commercial type boiler) is equipped with the invention. The feeder unit burner is supplied with all the air and about half or more of the fuel, which is combusted in the lower combustion tube. The burner uses Lean Premix low-NOx technology. The products of combustion are then feed into the "air" inlet of the receiver burner and the remainder of the fuel is added. The exhaust of the feeder burner is equivalent to 20–30% flue gas recirculation which is well mixed with receiver unit combustion air. The exhaust from the receiver is close in temperature and composition to a normal fired unit with same efficiency.

Case 2: Since the above has the additional cost of another burner, it may not be economically feasible for gas firing. However when used with fuels with large amounts of fuel bound nitrogen it may be the only method to significantly reduce NOx. The feeder burner will combust most of the fuel at a very rich stoichiometry. The combustion is then completed in the receiver tube with additional ("overfire") air and natural gas reburn as is well known in the art. The exhaust from the receiver is close in temperature and composition to a normal fired unit with same efficiency.

Figure 9:
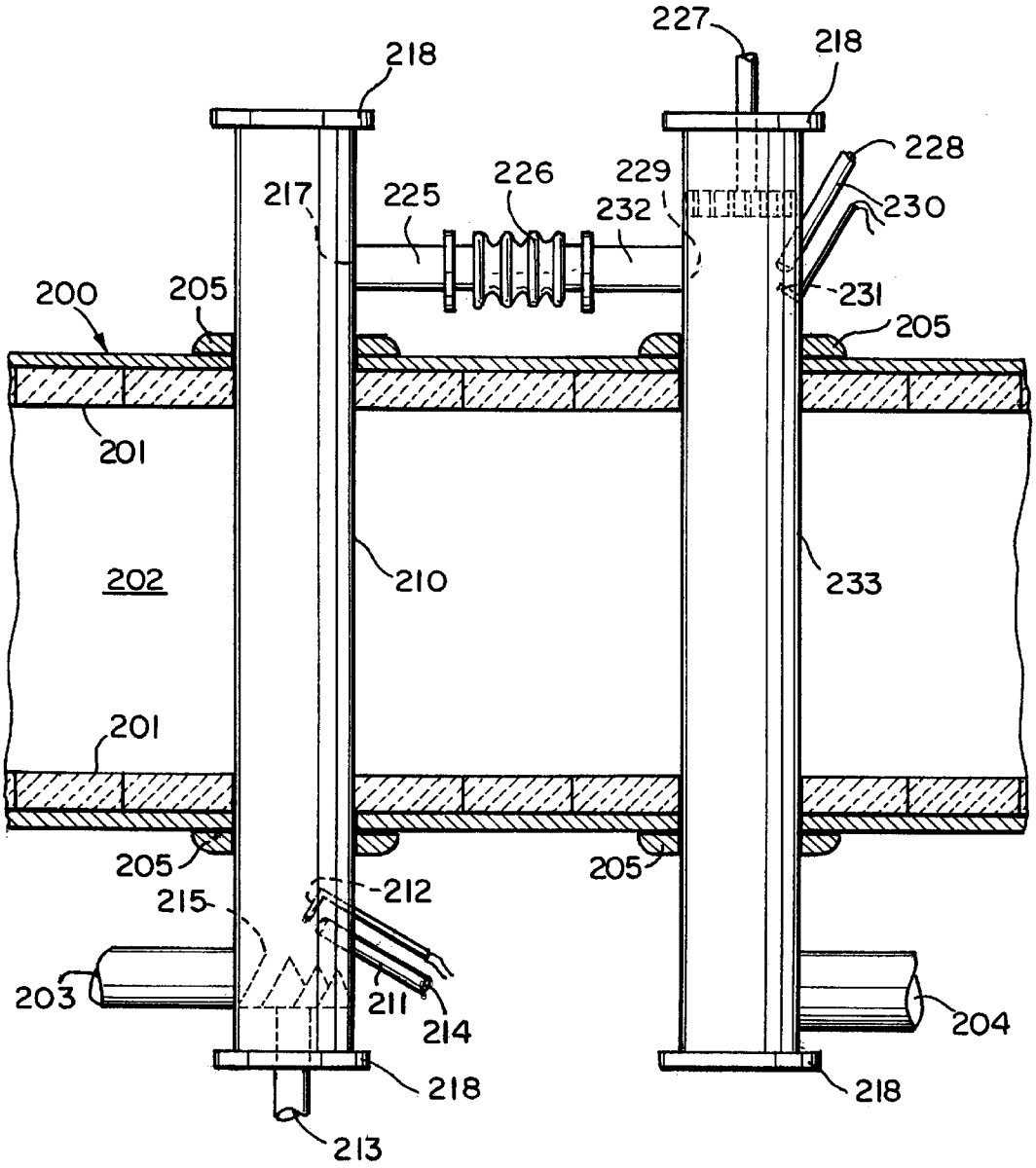
FIG. 9 is a partial view of an insulated furnace employing the present invention showing a duct in section at the location of a radiant tube heating system, shown in elevation.

FIG. 9 illustrates an alternative furnace arrangement employing the invention. The furnace casing 200 is lined with refractory lining 201 which encloses the furnace work space 202. The feeder radiant tube 210 and receiver radiant tube 233 pass through the furnace casing 200 and refractory lining 201 and provide radiant heating to the furnace work space 202, usually with an air-tight seal formed by radiant tube mounting flanges 205. The feeder radiant tube 210 and receiver radiant tube 233 are provided with radiant tube end caps 218. Normally the feeder radiant tube 210 and receiver radiant tube 233 would not be connected but exhaust directly to a collection duct (not shown) and the stack (not shown). This invention pairs and connects the tubes so that there is feeder radiant tube 210 and receiver radiant tube (233). Most furnaces of this type are equipped with many radiant tubes so that multiple pairing of radiant tubes is convenient and relatively easily accomplished.

The unit forced combustion air is delivered through duct 203 and feeder fuel is delivered through line 213. Both or either of these supplies may or may not be preheated as they enter the feeder burner 215 which uses either lean pre-mix or quick mix technology to obtain low-NOx. The feeder radiant tube is equipped with a feeder pilot 211, a feeder pilot air and gas mix 214 and an igniter/flame sensor 212. Combustion is completed in the feeder radiant tube 210 and the flow exits at the feeder radiant tube exhaust 217 into feeder exhaust connector pipe 225, through expansion connector 226 into the receiver burner mix supply region 229.

The receiver burner mix supply region 229 contains enough air for complete combustion of the receiver fuel supplied through line 227 and they mix and combust in the receiver radiant tube 233 and exit through the unit exhaust 204. A receiver pilot 230 is supplied with air/fuel mixture receiver burner pilot air and gas mix 228, which is ignited by the receiver pilot igniter/flame sensor 231. The heat release to the furnace work space 202 from the feeder radiant tube 210 and receiver radiant tube 233 are normally equal. However the feeder radiant tube 210 will always be fired with more fuel, the proportional amount depending on the temperature of preheat of the unit forced combustion air 203.

Some low-NOx radiant tubes use staged combustion which in the long term causes metal dusting and holes in the radiant tube. This is due to the change of the atmosphere in the radiant tube from reducing (fuel-rich) to oxidizing (excess air) caused by the staged flame pattern. This invention maintains an oxidizing atmosphere throughout the radiant tube, thus reducing dusting problems.

Some commercial low NOx radiant tubes use the forced combustion air acting through a venturi to create suction which through a connection leg to the radiant tube exhaust, inspirates flue gases. This generates a FGR type low NOx combustion. However, inspirating of hot flue gas and the inefficiency of the venturi/inspirator result in a costly electrical energy penalty for the combustion air fan.

The advantages of the invention embodiment of FIG. 9 and its variations are that there is less chance of metal dusting in the radiant tubes which results in longer life, lower electrical energy consumption, and also a reduction in ducting since the pair requires only one combustion air inlet and one exhaust outlet rather than the two required for the conventional arrangement.

The radiant tube is a method of indirect heat exchange used in industry. Heating is by radiation, therefore the external surface temperature of the tubes is from 1200–2000 F. (depending on process requirements and temperature limits of the tube materials). There are often a large number of radiant tubes in an industrial furnace, thus enough to make many feeder/receiver pairs as shown in FIG. 9.

The above description of specific embodiments of the invention not only gives various specific forms which the invention may take but also suggests how variations in those form may be made. There are also various ways in which heater systems in accordance with the present invention can be used and some of the alternate ways of using them are suggested. It will, therefore, be clear to those skilled in the art that there are many possible variations to the present invention, some of which have not been specifically covered and some which have not even been suggested. Such variations within the scope of the claim are intended to be within the scope and spirit of the present invention.

I claim:

1. A self contained heating system, for reducing NOx in combustion waste gases while obtaining good thermal efficiency, which comprises at least one feeder burner liberating heat by mixing and burning combustion components to produce a first combustion product, at least one receiver burner, in at least one receiver compartment separate from the feeder burner, conduit means for injecting at least part of the first combustion product from the at least one feeder burner into the combustion compartment of the at least one receiver burner, and means for separately injecting at least one combustion component into the first combustion product at the at least one receiver burner so that the at least one combustion component and the first combustion product may be burned together and so that the second combustion product produced thereby is safe and legal to release to the atmosphere.

2. The heating system of claim 1 in which at least some of the receiver burners and their receiver compartments are intergrated into a common heater structure with the feeder burner and the conduit means are internal of the heater structure so that the first combustion product therein may be used to supply heat to the heating system and output.

3. The heating system of claim 1 in which the conduits from each feeded burner to receiver burners are external.

4. The self-contained heating system of claim 3 in which the receiver burner is also provided with a supply of air to be burned with the fuel and the first combustion product.

5. The heating system of claim 3 in which the first and second combustion compartments are internal to the heater and make good thermal contact with the walls of the container for the fluid to be heated.

6. The heater of claim 5 in which the connection passage is also internal to the heater.

7. The self-contained heating system of claim 1 wherein the system is a heater providing greater efficiency in heating with less NOx in its effluent than prior devices, comprising:

a first compartment containing the at least one feeder burner having a fuel supply and an air supply to produce and heat the first combustion product;

a second combustion chamber having the at least one receiver burner having at least a fuel supply to be mixed with the heated first combustion product which when burned produces the second combustion product of much reduced NOx; and the conduit is a connection passage between the first and second combustion compartments oriented to allow passage of the first combustion product to the at least one receiver burner in the second combustion compartment for burning at the receiver burner.

8. The self-contained heating system of claim 7 in which the receiver burner is also provided with a supply of air to add into the mixture to be burned with air and the first combustion product.

9. The self-contained heating system of claim 1 wherein the system is a two stage heater for fluid to be heated, comprising:

a compartment for the fluid to be heated defined at least in part by internal heat transmitting walls;

a first combustion compartment having as at least part of its bounding walls part of the heat transmitting walls of the compartment for the fluid to be heated and containing the at least one feeder burner connectable to a supply of fuel and having an air supply enabling the fuel to be burned to produce a heated first combustion product;

the second combustion compartment having as at least part of its bounding walls part of the heat transmitting walls of the compartment for the fluid to be heated and containing at least one receiver burner having at least a fuel supply to mix with the heated first combustion product; and the conduit is a passage between the first and second combustion compartments whereby the first heated combustion product can flow into the second combustion compartment in position to combine with and add heat to at least fuel and be burned by the at least one receiver burner to make a second combustion product.

10. The self-contained heating system of claim 9 in which air supply means is provided to supply at least heat to the combustion at least one receiver burner.

11. The two stage heater of claim 9 in which a further exhaust compartment has as at least part of its bounding walls part of the heat transmitting walls of the compartment for the fluid to be heated and a further passage between the second combustion compartment and the exhaust compartment and an exhaust duct remote from the further passage.

12. The two stage heater of claim 11 in which the passage and further passage each consist of-at least one duct passing between connected chambers and extending at some length as a radiant heat surface through the chamber for fluid to be heated.

13. The two stage heater of claim 12 in which each passage consists of multiple ducts in order to increase the radiant heat surface for radiating heat within the chamber for fluid to be heated.

14. The self-contained heating system of claim 1 wherein the system is a hot air heater comprising:

at least one air heating compartment having an air intake port and ductwork output provided with a blower whereby air may be drawn through the at least one air heating compartment;

the at least one first combustion compartment containing the at least one feeder burner to which air and fuel are fed to produce a first combustion product in the form of hot gases;

each at least one second combustion compartment having at least one receiver burner to which at least fuel and the heated first combustion product from the at least one feeder burner are fed and burned to produce a second combustion product in the form of hot gases;

an exhaust compartment in which the second combustion product is collected as exhaust gases for evacuation through an exhaust duct; and connection ducts having radiant heat transferring walls connecting the first and second combustion compartments and the second combustion and exhaust compartments passing through the at least one air heating compartment whereby air passing through the air heating compartment is heated from the connection ducts.

15. The self-contained heating system of claim 1 comprising:

an array of heaters, each having:

a separate combustion compartment and a burner with fuel supply means and air supply means arranged to permit burning of the fuel and produce an exhaust;

wherein one heater is designated as an exhaust supply heater and its burner the feeder burner, and the exhaust from the exhaust supply heater is supplied to each of the remaining receiver heaters for inclusion in a burner combustion mix for the receiver burners in each remaining heater, in controlled amounts to achieve more efficient burning and lower levels of NOx.

16. The heating system of claim 15 in which valves in the exhaust supply to each of the remaining burners allows individual burners to be cut off from the supply heater exhaust or left connected to selectively keep each remaining connected heater warm when the receiving burner is not operating.

17. The self-contained heating system of claim 1 wherein the system is a water heater, comprising:

a water tank having a cold water input pipe and a hot water output and walls in at least heat application regions which transmit heat;

a first combustion compartment having the at least one feeder burner to which fuel and air are fed and burned to produce a first combustion product in the form of hot gases which are applied to regions of the water tank which transmit heat;

a second combustion compartment having the at least one receiver burner to which fuel and air and the first combustion product are fed and burned to produce a second combustion product in the form of hot gases which are applied to regions of the water tank which transmit heat;

the conduit is a connection duct between the first and second compartments which has a side in contact with regions of the water tank which transmit heat; and an exhaust duct from the second combustion compartment which places the hot exhaust gases in contact with regions of the water tank which transmit heat.

18. The self-contained heating system of claim 1 wherein the system comprises:

a water tank having generally parallel heating tubes extending therethrough from end to end and through tank end walls;

end closures around the ends of the tank enclosing space at the respective ends of the tubes and together with the tank end walls providing at least in part of the respective combustion compartments formed thereby:

one chamber being subdivided by a chamber dividing wall to form an exhaust compartment and the feeder burner combustion compartment, respectively, with the at least one feeder burner in or adjacent to the feeder burner compartment so that tubes on one side of the wall from the feeder burner combustion chamber carry the first combustion product through those tubes toward the receiver burner combustion chamber with the receiver burner in or adjacent to the feeder burner compartment, and tubes on the other side of the wall carry the second combustion product from the receiver burner to the exhaust chamber, the at least one feeder burner receiving and burning fuel and air to produce the first combustion product; and the at least one receiver burner receiving and burning at least air and the first combustion product of the feeder burner to produce the second combustion product.

19. The self-contained heating system of claim 18 in which the receiver burner is provided with a supply of fuel to be burned with air and the first combustion product.

20. The water heater of claim 19 in which the tank is torroidal, thereby providing a central exhaust duct having the walls which transmit heat; the receiver burner is located generally centrally below the tank; the feeder burner beneath the tank at one edge; and the conduction duct arranged along a lengthy path beneath the tank.

21. The water boiler of claim 19 in which the boiler is elongated and arranged generally horizontally and the heating tubes are parallel to each other in a generally horizontal array.

22. The self-contained heating system of claim 1 wherein the system comprises:

a water tank having generally parallel heating tubes extending there through from end to end;

end closures around the ends of the tank enclosing the ends of the tubes and together with portions of the tank walls providing at least in part of the respective first and second combustion compartments formed thereby;

one chamber being subdivided by a chamber dividing wall to form the first combustion compartment and a second receiver compartment, respectively, so that tubes on one side of the wall from the first combustion chamber carry the first combustion product toward the second combustion chamber, and tubes on the other side of the wall carry the second combustion product from the second combustion chamber to the exhaust chamber;

the feeder burner in the first combustion chamber receiving and burning fuel and air to produce the first combustion product; and the receiver burner in the second receiver compartment for receiving and burning at least fuel and the heated first combustion product of the feeder burner to produce the second combustion product.

23. The self-contained system of claim 22 in which the receiver burner is provided with a supply of air to be burned with the fuel and the first combustion product.

24. The self-contained heating system of claim 1 which is a furnace heating system, comprising:

an insulated furnace housing having closed ends at each end, a pair of radiant tubes transverse to the furnace housing, each extending through the housing; and the first combustion chamber containing the at least one feeder burner being at one end of one of the pair of metal tubes for burning fuel and air supplied to the combustion feeder burner chamber, to produce the first combustion product and heat which heats the furnace through the one radiant tube;

the conduit is a connection between the radiant tubes at the end remote from the feeder burner, the conduit causing the first combustion product to flow into the connected other tube;

the second combustion chamber containing the at least one receiver burner at the end of the connected tube being in position to receive the first combustion product as well as at least fuel supplied through lines to the other radiant tube, and burn the combination to produce heat and a second combustion product which flows through the connected other tube heating the furnace, and an exhaust tube connected to the other radiant tube through which the second combustion product is exhausted.

25. The self-contained heating system of claim 24 in which the receiver burner is provided with a supply of air to be burned with the fuel and the first combustion product.

26. The furnace heating system of claim 1 in which the furnace is lined with refractory material and heat seals are provided at the radiant tubes where they extend through the furnace housing.

27. The self-contained heating system of claim 1 which is a furnace heating system, comprising:

an insulated furnace housing having closed ends at each end, a pair of radiant tubes transverse to the furnace housing, each extending through the housing; and the first combustion chamber containing the at least one feeder burner being a chamber at one open end of one of the pair of radiant tubes for burning fuel and air supplied to the combustion feeder burner chamber, to produce the first combustion product and heat which heats the furnace through the one radiant tube;

the conduit is a connection between the radiant tubes at the end remote from the feeder burner which also provides a combustion chamber for a receiver burner, the conduit causing the first combustion product to flow into the other radiant tube and burn the combination at the receiver burner to produce heat and a second combustion product which flows through the connected other radiant tube heating the furnace; and an exhaust from the other radiant tube through which the second combustion product is exhausted.

28. A method of reducing NOx in a heating system, comprising the steps of:

burning fuel in a first compartment of the heating system to produce a first combustion product;

feeding the first combustion product into a second compartment of the heater system and mixing it at least with new air and burning the mixture in the second compartment of the heater system to produce a second combustion product; and using the heat of both combustion products for system heating.

29. The method of claim 1 in which both new air and new fuel are mixed with the first combustion product and burned in the second compartment of the heating system.

30. A method of reducing NOx in a heating system, comprising the steps of:

burning fuel in a first compartment of the heating system to produce a heated first combustion product;

feeding the first combustion product into a second compartment of the heating system into which the first combustion product as well as at least new fuel is introduced and burning the mixture in the second compartment of the heater to produce a second combustion product; and applying heat from both combustion products for system heating.

31. The method of claim 30 in which both new fuel and new air are mixed with the first combustion product and burned in the second compartment of the heating system.

* * * * *